US006176484B1

(12) United States Patent
Greive et al.

(10) Patent No.: US 6,176,484 B1
(45) Date of Patent: Jan. 23, 2001

(54) DEVICE FOR TRANSPORTING SHEETS OR FOLDED PRODUCTS

(75) Inventors: Martin Greive, Schönau; Clemens Rensch, Heidelberg, both of (DE)

(73) Assignee: Heidelberger Druckmaschinen Aktiengesellschaft, Heidelberg (DE)

( * ) Notice: Under 35 U.S.C. 154(b), the term of this patent shall be extended for 0 days.

(21) Appl. No.: 09/248,450

(22) Filed: Feb. 11, 1999

(30) Foreign Application Priority Data

Feb. 11, 1998 (DE) ..... 198 05 392

(51) Int. Cl.[7] ..... B65H 5/02

(52) U.S. Cl. ..... 271/277; 271/204; 198/470.1; 198/803.7

(58) Field of Search ..... 271/204, 277; 198/470.1, 803.7

(56) References Cited

U.S. PATENT DOCUMENTS

| | | | | |
|---|---|---|---|---|
| 2,880,997 | | 4/1959 | Brown | 271/45 |
| 4,073,489 | * | 2/1978 | Idstein et al. | 271/277 |
| 4,138,102 | * | 2/1979 | Palmer | 271/3 |
| 4,404,905 | * | 9/1983 | Simeth et al. | 101/183 |
| 4,592,279 | * | 6/1986 | Kemmerer | 101/412 |
| 4,812,064 | * | 3/1989 | Hatakeyama et al. | 400/622 |
| 4,849,795 | * | 7/1989 | Spehrley, Jr. et al. | 355/317 |
| 5,102,111 | * | 4/1992 | Reponty | 270/12 |
| 5,267,510 | * | 12/1993 | Hartung et al. | 101/142 |
| 5,596,932 | * | 1/1997 | Honegger | 101/485 |
| 5,645,564 | * | 7/1997 | Northrup et al. | 606/205 |

FOREIGN PATENT DOCUMENTS

| | | |
|---|---|---|
| 1082353 | 5/1960 | (DE) . |
| 1241647 | 6/1967 | (DE) . |
| 2113750 | 9/1973 | (DE) . |
| 4113390A1 | 11/1991 | (DE) . |
| 4114095C1 | 7/1992 | (DE) . |

* cited by examiner

*Primary Examiner*—Christopher P. Ellis
*Assistant Examiner*—Richard Ridley
(74) *Attorney, Agent, or Firm*—Herbert L. Lerner; Laurence A. Greenberg; Werner H. Stemer

(57) ABSTRACT

A device for transporting a sheet or a folded product by a transport belt includes at least one holder for holding the sheet or the folded product, the holder being operatable by an effect selected from the group consisting of magnetic and thermal effects.

8 Claims, 2 Drawing Sheets

DEVICE FOR TRANSPORTING SHEETS OR FOLDED PRODUCTS

BACKGROUND OF THE INVENTION

Field of the Invention

The invention relates to a device for transporting sheets or folded products which are to be fed to a printing machine or which are to be led away from a printing machine or which are to be printed, on a transport path thereof, by an ink jet printing unit.

From the published German Patent Document DE 41 14 095 C1, it has become known heretofore to use as a transporter or conveyor a flexible steel belt having gripper tongues spaced apart from one another in the transport direction. The gripper tongues, together with the transport belt, form a gripper opening which is directed, respectively, in and counter to the transport direction and which receives therein an end of a sheet or folded product in order to grip and transport the latter and to wind it up.

An opening and closing movement of the gripper formed by the gripper tongue and transport belt is controlled by the curvature of a deflection roller for the transport belt.

In the case of the hereinaforementioned device disclosed by the published German Patent Document DE 41 14 095 C1, the opening and closing times of the tongue gripper are disadvantageously defined by the curvature and position of the deflection rollers.

SUMMARY OF THE INVENTION

It is accordingly an object of the invention to provide a transport device for sheets or folded products, that has at least one flexible transport belt and grippers fastened thereto, the grippers having freely selectable opening and closing times.

With the foregoing and other objects in view, there is provided, in accordance with the invention, a device for transporting a sheet or a folded product by a transport belt, comprising at least one holder for holding the sheet or the folded product, the holder being operatable by an effect selected from the group consisting of magnetic and thermal effects.

In accordance with another feature of the invention, the at least one holder is operatable via a magnetic source.

In accordance with a further feature of the invention, the at least one holder is operatable via a heat source.

In accordance with an added feature of the invention, the at least one holder is a gripper tongue directly cooperatable under prestressing force with the transport belt.

In accordance with an additional feature of the invention, the transporting device includes another transport belt arranged parallel to the first-mentioned transport belt, and the at least one holder is a gripper tongue cooperatable under prestressing force with a gripper bar extending from the first-mentioned transport belt to the other transport belt.

In accordance with yet another feature of the invention, the at least one holder is openable for releasing the sheet or the folded product, and an opening device is included for generating a magnetic field for opening the at least one holder.

In accordance with yet a further feature of the invention, the opening device is a permanent magnet.

In accordance with an alternative feature of the invention, the opening device is an activatable electromagnet.

In accordance with yet an added feature of the invention, the at least one holder is openable for releasing the sheet or the folded product, and an opening device is included for generating radiant heat for opening the at least one holder.

In accordance with yet an additional feature of the invention, the opening device is a laser.

In accordance with still another feature of the invention, the at least one holder is formed of magnetizable resilient steel.

In accordance with an alternative feature of the invention, the at least one holder is formed of a resilient bimetal.

In accordance with still a further feature of the invention, the at least one holder is a gripper tongue, and a spot-weld connection is provided for fastening the gripper tongue to the transport belt.

In accordance with an alternative feature of the invention, the at least one holder is a gripper tongue, and a spot-weld connection is included for fastening the gripper tongue to the gripper bar.

In accordance with still an additional feature of the invention, the transporting device includes an ink jet printing unit arranged at a slight distance from the transport belt.

In accordance with a concomitant feature of the invention, the transporting device includes an ink jet printing unit arranged at a slight distance from the gripper bar.

A significant advantage of the invention is the free selection of the opening and closing times for the gripper tongues, arranged on the transport belt, by means of an opening device which can be arranged freely. By this means, the transport device can be arranged independently of the installation position of the deflection roll.

The sheets or folded products transported by means of the device according to the invention can thus be accepted from a processing station or a reservoir, for example a sheet stack, at any point—corresponding to the arrangement of the opening or closing device of the transport belt—and transferred to another processing station or another reservoir, for example a sheet deposit point.

In an advantageous refinement, the transport device according to the invention comprises at least one magnetizable gripper tongue which is fastened to the flexible, nonmagnetic transport belt. In the case of an austenitic steel belt, the fastening is preferably made by spot welding. The gripper produced in this way is very flat and can for example, transport a gripped sheet through a printing gap of an ink jet printing unit.

In a second exemplary embodiment for the transport means, provision is made for a gripper strip which bears a number of gripper tongues arranged alongside one another to be arranged between two transport belts.

In the preferred exemplary embodiment for the opening device, the opening means is a permanent magnet or an electromagnet which can be activated. In a further exemplary embodiment for the opening device, the opening or closing means is a laser which, by means of heating, opens a gripper tongue designed as a bimetallic strip.

Other features which are considered as characteristic for the invention are set forth in the appended claims.

Although the invention is illustrated and described herein as embodied in a device for transporting sheets or folded products, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
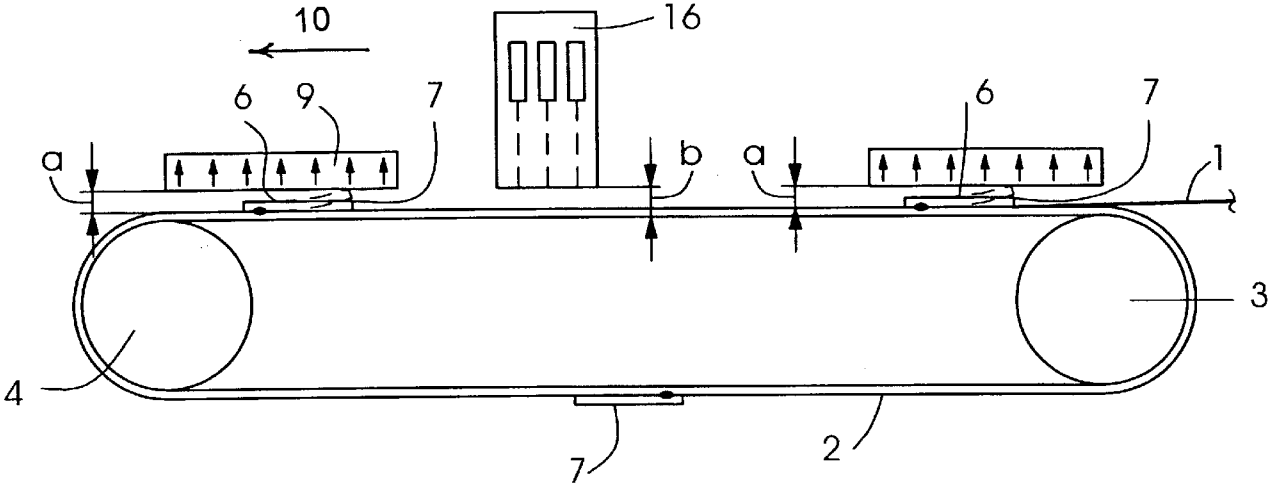
FIG. 1 is a diagrammatic side elevational view of a first exemplary embodiment of the transport device according to the invention.
Figure 5:
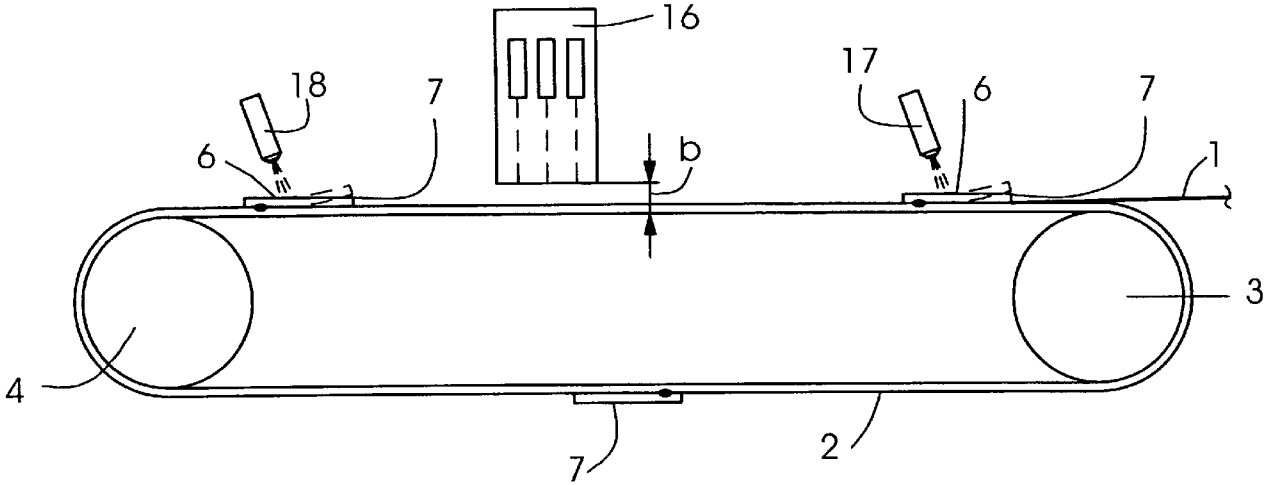
FIG. 5 is a view like that of FIG. 1 of a second exemplary embodiment of the transport device according to the invention.
Figure 2:
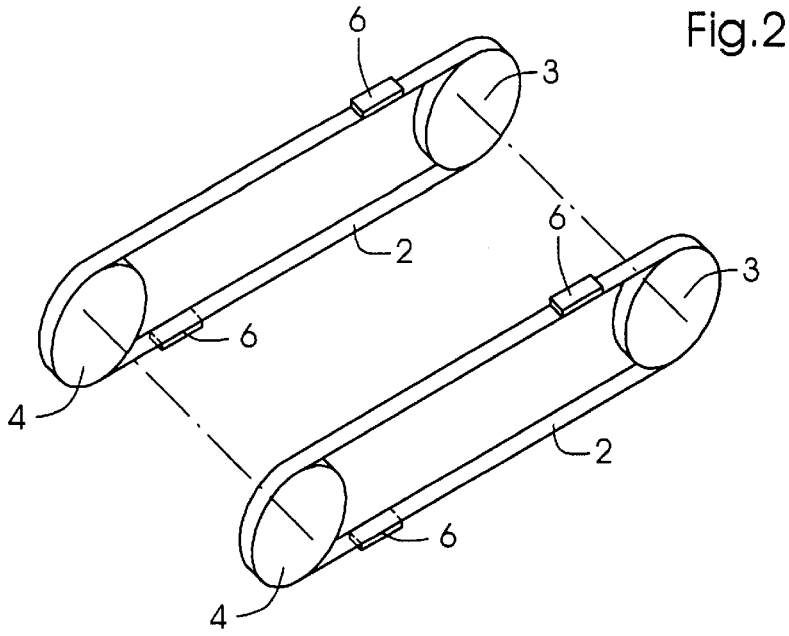
FIG. 2 is a diagrammatic end, side and top perspective view of the transport device with two transport belts.

Referring now to the drawings and, first, particularly to FIGS. 1 and 2 thereof, there is shown therein a device according to the invention for transporting sheets 1, the device being essentially formed of a flexible transport belt 2 and at least two deflection rollers 3 and 4, of which at least one is driven.

Fastened to the transport belt 2 is at least one gripper tongue 6 which, together with the transport belt 2, defines a gripper opening 7 therebetween. The gripper tongue 6 is formed of a thin magnetizable metal plate, preferably a spring-steel sheet. The gripper tongue 6 is fastened to the transport belt 2 by an end thereof directed in a sheet transport direction represented by the horizontal arrow 10, so that the opening 7 formed between the gripper tongue 6 and the transport belt 2 is directed counter to the transport direction 10. In the exemplary embodiment of FIGS. 1 and 2, the transport belt 2 is a steel belt formed of non-magnetizable steel, for example austenitic steel. The gripper tongue 6 is fastened to the steel belt 2 by spot welding.

The gripper tongue 6 is arranged under prestressing on the steel belt 2. A magnetic device 9 is provided for neutralizing the prestressing force and lifting the gripper tongue 6, a function which corresponds to that of opening a gripper. The magnetic device 9 may be a permanent magnet or an activatable electromagnet, and is arranged at a desired location at which the gripper tongue 6 is to be opened, the location being as short a distance a as possible (a=about 1 to 5 mm) from the transport belt 2.

In a receiving position, the gripper tongue 6 enters the force field of the magnetic device 9, and the gripper tongue 6 is lifted off the transport belt 2 counter to the prestressing force. Printing material, for example the sheet 1, to be transported is conveyed into the opening 7 between the gripper tongue 6 and the transport belt 2 by a non-illustrated conveying device. When the magnetic force field has left or has been switched off, the gripper tongue 6 closes due to the applied prestressing force, and clamps the sheet 1 firmly to the transport belt 2. At a transfer location, a second magnetic device 9 is provided which lifts the gripper tongue 6 off the transport belt 2 and thus releases the sheet 1. The latter is accepted by a non-illustrated conveying device or deposited on a non-illustrated sheet pile.

Figure 3:
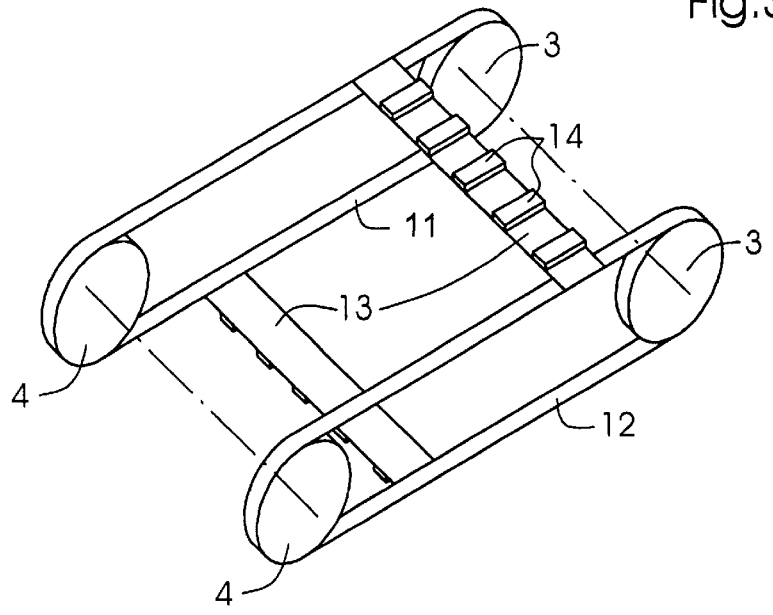
FIG. 3 is a view like that of FIG. 2 of the transport device provided with a gripper strip.
Figure 4:
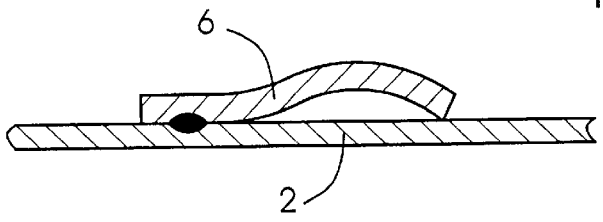
FIG. 4 is an enlarged fragmentary sectional view of FIG. 1 showing a prestressed gripper tongue according to the invention.

In a second exemplary embodiment shown in FIG. 3, provision is made for a gripper bar 13 to be arranged transversely to the sheet transport direction represented by the arrow 10 (note FIG. 1) between two transport belts 11 and 12 which are arranged in parallel, the gripper bar 13 being fastened by respective ends thereof to the transport belts 11 and 12, respectively. The gripper bar 13 carries a plurality of gripper tongues 14 which are spaced apart from one another, are fastened by a leading end thereof to the gripper bar 13 and act, by a trailing end thereof, under a prestressing force, on the gripper bar 13. In contrast with the gripper bars 13 and the transport belts 11 and 12, the gripper tongues 14, just like the gripper tongue 6, are formed of magnetizable material, preferably spring-steel sheetmetal.

Magnetic devices 16, respectively, extending over the length of the gripper bar 13 and having a magnetic force field reaching all the gripper tongues 14 of the gripper bar 13, are applied, in the provided opening positions for the gripper tongues 14. The manner in which the gripper tongues 14 are opened corresponds to that for opening the gripper tongue 6 of the first exemplary embodiment shown in FIGS. 1 and 2.

As FIG. 1 illustrates, an ink jet printing unit 16, that provides single-color or multicolor applications to a sheet which has already been partially printed or which is unprinted, can be arranged at a slight distance b (b=1–5 mm) from the planar sheet guide path formed by the transport belt 2.

It is further proposed that the gripper tongues 6 and 14 be formed of a resilient bimetal. Accordingly, the switching element provided to open the gripper tongues 6 and 14 may also be a heat source 17, for example, formed as a laser.

We claim:

1. A device for transporting a sheet or a folded product by a transport belt, comprising:

at least one holder having a closed position for holding the sheet or the folded product and an open position for releasing the sheet or the folded product, said holder capable of being switched from the closed position to the open position by heat applied thereto; and a laser for generating radiant heat for switching said holder to the open position.

2. The transporting device according to claim 1, wherein said at least one holder is a gripper tongue directly cooperatable under prestressing force with the transport belt.

3. The transporting device according to claim 1, including another transport belt arranged parallel to the first-mentioned transport belt, and wherein said at least one holder is a gripper tongue cooperatable under prestressing force with a gripper bar extending from the first-mentioned transport belt to said other transport belt.

4. The transporting device according to claim 1, wherein said at least one holder is formed of a resilient bimetal.

5. The transporting device according to claim 1, wherein said at least one holder is a gripper tongue, and including a spot-weld connection fastening said gripper tongue to the transport belt.

6. The transporting device according to claim 3, wherein said at least one holder is a gripper tongue, and including a spot-weld connection fastening said gripper tongue to said gripper bar.

7. The transporting device according to claim 1, including an ink jet printing unit arranged at a slight distance from the transport belt.

8. The transporting device according to claim 3, including an ink jet printing unit arranged at a slight distance from said gripper bar.

* * * * *